US010294063B2

(12) United States Patent
Mutsuno et al.

(10) Patent No.: US 10,294,063 B2
(45) Date of Patent: May 21, 2019

(54) SHEET PROCESSING APPARATUS WITH DELAYED PROCESSING

(71) Applicant: CANON KABUSHIKI KAISHA, Tokyo (JP)

(72) Inventors: Masahiro Mutsuno, Tokyo (JP); Masaki Kashiwagi, Hiratsuka (JP); Akinori Takeo, Yokohama (JP); Satoshi Totsuka, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 123 days.

(21) Appl. No.: 14/975,469

(22) Filed: Dec. 18, 2015

(65) Prior Publication Data

US 2016/0185563 A1 Jun. 30, 2016

(30) Foreign Application Priority Data

Dec. 25, 2014 (JP) ..... 2014-263179

(51) Int. Cl.

| | |
|---|---|
| ***B65H 37/04*** | (2006.01) |
| ***B65H 43/06*** | (2006.01) |
| ***G03G 15/00*** | (2006.01) |
| ***B65H 39/10*** | (2006.01) |

(52) U.S. Cl.

CPC ..... *B65H 43/06* (2013.01); *B65H 37/04* (2013.01); *B65H 39/10* (2013.01); *G03G 15/6582* (2013.01); *G03G 15/6591* (2013.01); *G03G 2215/00827* (2013.01)

(58) Field of Classification Search

CPC ..... B65H 37/04; B65H 2408/121; B65H 2408/122; B65H 2553/41; B65H 2557/354; B65H 2557/64; B65H 2801/06; G03G 15/502; G03G 15/6544; G03G 2215/00721

See application file for complete search history.

(56) References Cited

U.S. PATENT DOCUMENTS

| | | | | |
|---|---|---|---|---|
| 4,801,133 | A * | 1/1989 | Ishiguro | B42C 1/125 227/78 |
| 6,850,719 | B2 * | 2/2005 | Nagaya | B65H 43/00 399/16 |
| 9,139,397 | B2 * | 9/2015 | Sato | B42B 9/00 |
| 9,856,105 | B2 * | 1/2018 | Mutsuno | B65H 43/00 |
| 2007/0279646 | A1 * | 12/2007 | Sugimoto | G03G 15/5004 358/1.1 |
| 2010/0321706 | A1 * | 12/2010 | Mori | G03G 15/6508 358/1.5 |

(Continued)

FOREIGN PATENT DOCUMENTS

| | | | |
|---|---|---|---|
| JP | S63-139876 | A1 | 6/1988 |
| JP | 2005107322 | A | 4/2005 |

(Continued)

*Primary Examiner* — Patrick H Mackey

(74) *Attorney, Agent, or Firm* — Canon U.S.A., Inc. IP Division

(57) ABSTRACT

A sheet processing apparatus includes a stapler that executes a stapling process on sheets set in a sheet insertion opening by a user, and a sheet detecting sensor that detects the sheets set in the sheet insertion opening. The sheet processing apparatus displays a setting screen for setting a time until the staple process is executed, and causes the stapler to execute the stapling process according to elapse of the set time after the sheet detecting sensor detects the sheets.

6 Claims, 8 Drawing Sheets

(56) References Cited

U.S. PATENT DOCUMENTS

| | | | | |
|---|---|---|---|---|
| 2011/0031677 | A1* | 2/2011 | Ozawa | B65H 29/34 270/58.12 |
| 2011/0062647 | A1* | 3/2011 | Tsuchiya | B42B 4/00 270/58.09 |
| 2013/0236269 | A1 | 9/2013 | Watanabe | |
| 2014/0334901 | A1 | 11/2014 | Sato | |
| 2015/0014384 | A1* | 1/2015 | Obuchi | B27F 7/17 227/99 |
| 2015/0021374 | A1* | 1/2015 | Kubo | B65H 37/04 227/39 |
| 2015/0021844 | A1* | 1/2015 | Kubo | B31F 5/001 270/1.01 |

FOREIGN PATENT DOCUMENTS

| | | | |
|---|---|---|---|
| JP | 2011-003005 | A | 1/2011 |
| JP | 2014-162590 | A | 8/2014 |
| JP | 2014218341 | A | 11/2014 |

* cited by examiner

SHEET PROCESSING APPARATUS WITH DELAYED PROCESSING

BACKGROUND OF THE INVENTION

Field of the Invention

The present invention relates to a sheet processing apparatus that processes sheets.

Description of the Related Art

Conventionally, a sheet processing apparatus that processes sheets is known. Concrete examples of the processes on sheets are a staple binding process (stapling) for binding a plurality of sheets using a staple, a stapleless binding process (stapleless stapling) for crimping a plurality of sheets to bind them without using a staple, and a punching process for making a punch hole on sheets, etc. These processes are referred to as "sheet processes".

As one example of the sheet processing apparatus, the apparatus is connected to a printing apparatus that prints an image on sheets and is used. When the sheet processing apparatus is connected to the printing apparatus, the sheet processing apparatus is connected to a down-stream side of the printing apparatus in a sheet conveyance direction. The sheet processing apparatus receives the sheets on which the image is printed from the printing apparatus, and executes the sheet process on the sheets.

Further, the sheet processing apparatus that is capable of not only processing sheets conveyed from the printing apparatus but also processing sheets set directly on the sheet processing apparatus by a user is known. Japanese Patent Application Laid-Open No. 2014-162590 discusses an insertion opening into which sheets to be processed are inserted, and a sheet processing apparatus that executes a sheet process on the sheets inserted into the insertion opening.

Japanese Patent Application Laid-Open No. 2011-003005 discusses a printing system that includes a function of executing a sheet process associated with image printing performed by a printing apparatus, and a function of executing a sheet process unassociated with image printing performed by the printing apparatus. Further, Japanese Patent Application Laid-Open No. 2011-003005 discusses that when a predetermined time passes with sheets being set on a sheet feeding unit of the printing system, conveyance of the sheets from the sheet feeding unit is automatically started and the sheet process unassociated with the printing is executed. Further, the predetermined time can be set to any time.

As stated above, Japanese Patent Application Laid-Open No. 2014-162590 discusses the insertion opening into which sheets to be processed are inserted, and the sheet processing apparatus that executes the sheet process on the sheets inserted into the insertion opening. However, since the sheet process discussed in Japanese Patent Application Laid-Open No. 2014-162590 is executed by user's pressing of a button, it requires a troublesome work to press the button. To solve this problem, a constitution such that the sheet process is automatically executed in response to the insertion of sheets into the insertion opening is considered.

However, the immediate execution of the sheet process in response to the insertion of the sheets into the insertion opening increases the probability of a failure such that the sheet process is executed on unintended places of the sheets in a case where an unaccustomed user does a work. On the other hand, when the sheet process is executed after a brief interval from the insertion of the sheets into the insertion opening, a waiting time is generated in each sheet process, and thus a working time is unnecessarily long for a skillful user.

Japanese Patent Application Laid-Open No. 2011-003005 discusses that a time until start of the conveyance of the sheets set on the sheet feeding unit is variably set, but does not discuss that a time until start of execution of the sheet process on sheets inserted into the insertion opening is variably set.

SUMMARY OF THE INVENTION

The present invention is directed to provide a system that enables a time until a sheet process is executed on sheets inserted into an insertion section to be variably set.

According to an aspect of the present invention, a sheet processing apparatus includes a sheet processing unit configured to execute a sheet process on sheets set on a processing position by a user, a detection unit configured to detect the set sheets, a setting unit configured to set a time until the sheet processing unit executes the sheet process, and a control unit configured to perform control to cause the sheet processing unit to execute the sheet process according to elapse of the time set by the setting unit after the detection unit detects the sheets.

Further features of the present invention will become apparent from the following description of exemplary embodiments with reference to the attached drawings.

DESCRIPTION OF THE EMBODIMENTS

Exemplary embodiments of the present invention are described below with reference to the drawings. The following exemplary embodiments do not limit the claimed invention, and not all combinations of the characteristics described in the exemplary embodiments are essential for the solutions provided by the invention.

Figure 1:
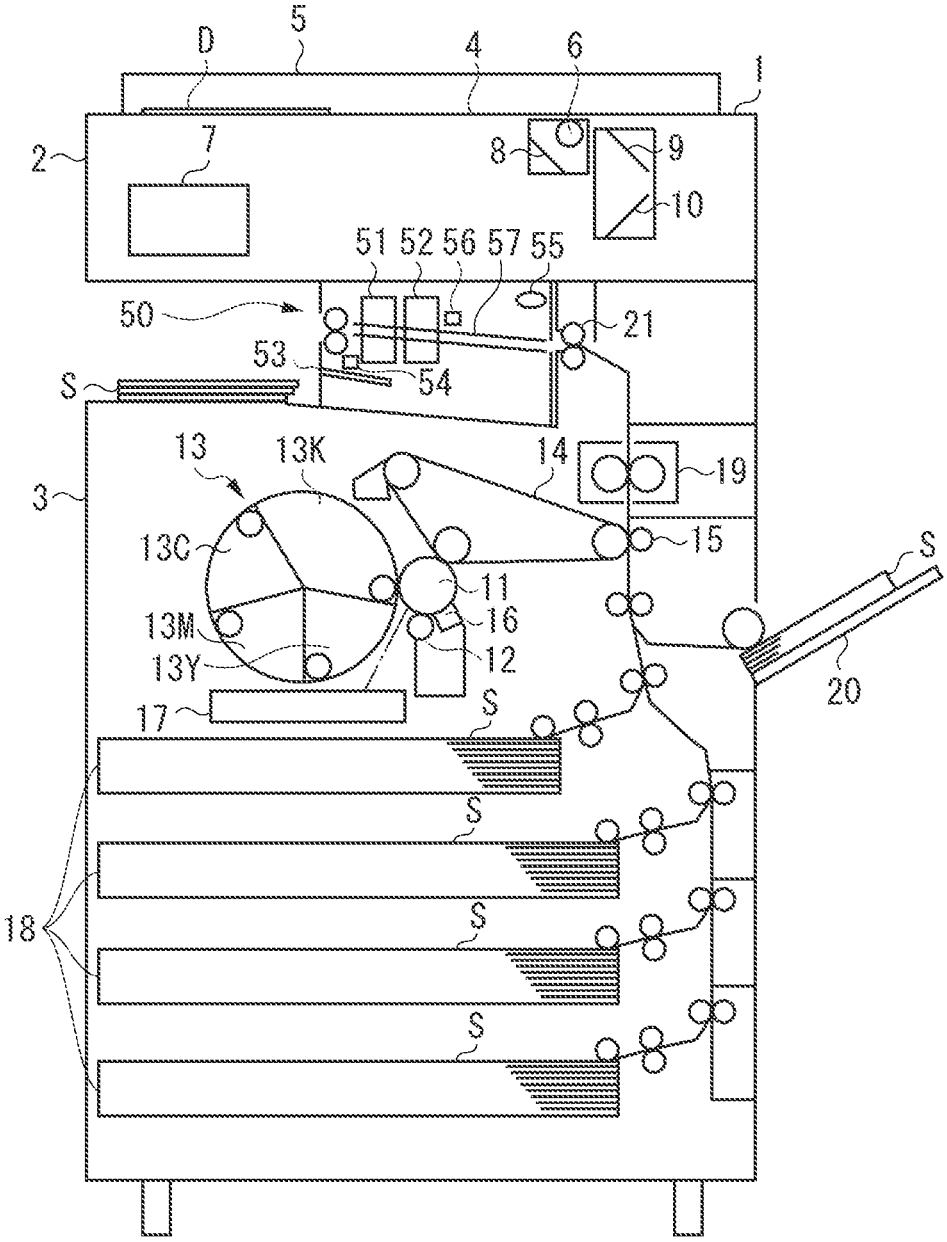
FIG. 1 is a cross sectional view illustrating a printing system according to an exemplary embodiment of the present invention.

A first exemplary embodiment of the present invention will be now described below. FIG. 1 is a cross sectional view illustrating an entire printing system including a sheet processing apparatus 50 to which the present invention is applied and a printing apparatus 1 to which the sheet processing apparatus 50 is connected. In the following explanation, the sheet processing apparatus 50 is treated as an apparatus separated from the printing apparatus 1. However, an entire part including a printing apparatus and the sheet processing apparatus 50 may be designated as a "printing apparatus", or an entire part including a sheet processing apparatus and the printing apparatus 1 may be designated as a "sheet processing apparatus".

The printing apparatus 1 is roughly constituted by two parts, which are a scanner 2 that reads an image on a document and generates image data and a printer 3 that forms an image on a sheet. A document positioning plate 4 including transparent glass is provided onto the scanner 2. A document D set at a predetermined position on the document positioning plate 4 with an image to be read facing down is pressed to be immobilized by a document pressing plate 5. Optical members including a lamp 6 that emits light onto the document D and reflection mirrors 8, 9, and 10 that lead reflected light to an image processing unit 7 are provided below the document positioning plate 4. The lamp 6 and the reflection mirrors 8, 9, and 10 move at a predetermined speed to scan the document D.

The printer 3 includes a photoconductive drum 11, a primary charging roller 12, a rotary developing unit 13, an intermediate transfer belt 14, a transfer roller 15, and a cleaner 16, etc. An electrostatic latent image is formed, on a surface of the photoconductive drum 11 by a laser beam emitted from a laser unit 17, based on the image data generated by reading of the image on the document D. The primary charging roller 12 uniformly charges the surface of the photoconductive drum 11 before the emission of the laser beam.

The rotary developing unit 13 makes toners of magenta (M), cyan (C), yellow (Y), and black (K) adhere to the electrostatic latent image formed on the surface of the photoconductive drum 11 to form a toner image. The toner image developed onto the surface of the photoconductive drum 11 is transferred to the intermediate transfer belt 14, and the toner image on the intermediate transfer belt 14 is transferred to a sheet S by the transfer roller 15. The cleaner 16 removes toner that remains on the photoconductive drum 11 after the toner image has been transferred therefrom.

The rotary developing unit 13 uses a rotary developing system, and has a developer 13K, a developer 13Y, a developer 13M, and a developer 13C, and is rotatable by a motor (not illustrated). In a case where a monochrome toner image is to be formed on the photoconductive drum 11, the developer 13K is rotated to be moved to a developing position near the photoconductive drum 11 to perform development. In a case where a full-color toner image is to be formed, the rotary developing unit 13 is rotated so that the respective developers are arranged on the developing position, and the development using each color is sequentially performed.

The sheet S to which the toner image on the intermediate transfer belt 14 is transferred is supplied from a cassette 18 or a manual feeding tray 20 to the transfer position. A fixing device 19 is provided to a down-stream side, in a conveyance direction the sheet S, of the transfer roller 15, and fixes the toner image on the sheet S to be conveyed. The sheet S onto which the toner image is fixed is discharged by a discharge roller pair 21, from the printing apparatus 1 to the sheet processing apparatus 50 located on the down-stream side in the conveyance direction.

The sheet processing apparatus 50 is configured to be connected to a sheet discharge position of the printing apparatus 1, and is configured to be communicable with the printing apparatus 1 via a signal line (not illustrated). The sheet processing apparatus 50 communicates with the printing apparatus 1 to thereby operate in cooperation with the printing apparatus 1. The sheet processing apparatus 50 includes a stapler 51 that binds a plurality of sheets S discharged by the discharge roller pair 21 using a staple, and a stapler 52 that binds a plurality of sheets without using a staple. The stapler 51 is movable as described below with reference to FIG. 3 and can execute a binding process at a plurality of places. On the other hand, the stapler 52 is fixed to one place, but the stapler 52 may be also configured to be movable. Further, a puncher that forms a punch hole in a sheet may be provided instead of the staplers.

The sheet processing apparatus 50 includes a sheet detecting sensor 56 that detects presence or absence of the sheets S, and a sheet aligning portion 57 that aligns the sheets S. The sheet processing apparatus 50 detects the sheets S conveyed to the sheet aligning portion 57 using the sheet detecting sensor 56, and executes the binding process (stapling) using the stapler 51 based on an instruction from a user, and a binding process (stapleless stapling) using the stapler 52.

Further, the sheet processing apparatus 50 has an off-line staple function of executing the staple process not on sheets supplied from the cassette 18 or the manual feeding tray 20 but on sheets directly set on the sheet processing apparatus 50 by the user. When the off-line staple is executed, the stapler 51 executes the staple process using the staple. The sheet insertion opening 53 is a place (an insertion portion) into which sheets to be processed are inserted by a user who uses the off-line staple function. The sheet insertion opening 53 is formed into a slit shape, and the user inserts end portions of the sheets into the slit. A sheet detecting sensor 54 detects that the sheets are inserted into the sheet insertion opening 53.

When the sheet detecting sensor 54 detects the sheets, an off-line mode is selected (the off-line mode is turned ON). When the user presses an execution button 55 with the off-line mode being ON, the stapler 51 executes a stapling process. Further, even when the user does not press the execution button 55, the stapling process is automatically executed in a case where the sheet detecting sensor 54 has continued to detect sheets for a predetermined time. This stapling process is executed on end portions of sheets inserted into the sheet insertion opening 53. The end portion of the sheet means a predetermined range from a sheet end (for example, 5 cm from the sheet end).

While the off-line mode is ON, an image printing operation to be performed by the printing apparatus 1 is limited. For this reason, the sheets are not conveyed from the printing apparatus 1 to the sheet processing apparatus 50. Further, the execution button 55 has a light emitting diode (LED) that can be lighted, and enables to notify the user of a state of the sheet processing apparatus 50 with the lighted LED. The lighting means that the execution button 55 is in a condition of being able to be pressed (namely, the execution of the sheet process can be instructed). Instead of the notification by the LED, display of a message or an output of a sound may be used for the notification.

Figure 2A:
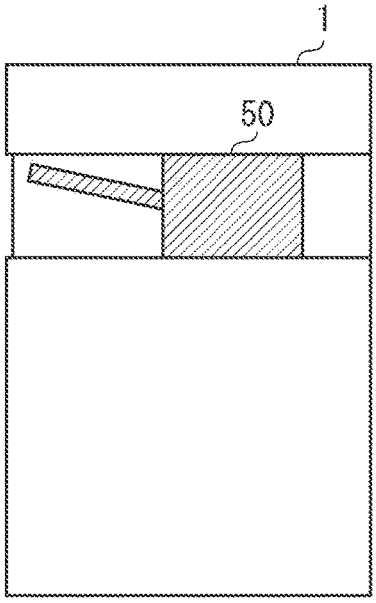
FIGS. 2A and 2B are schematic diagrams illustrating examples of connection between a printing apparatus 1 and a sheet processing apparatus 50 according to the exemplary embodiment of the present invention.
Figure 2B:
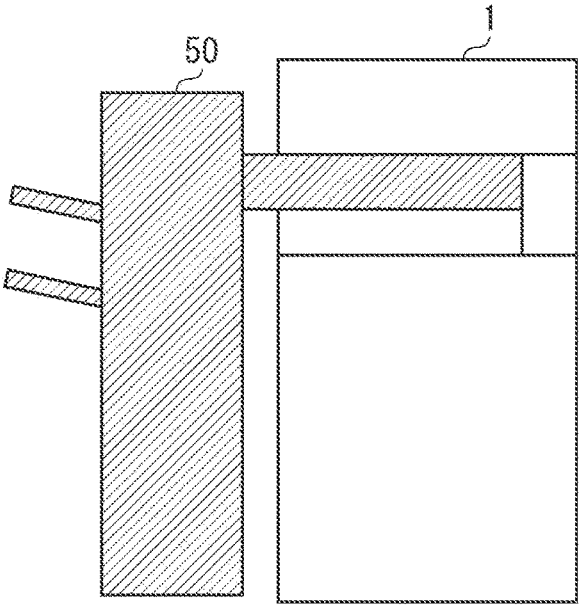

FIGS. 2A and 2B are schematic diagrams illustrating examples of connection of the sheet processing apparatus 50 to the printing apparatus 1. FIG. 2A illustrates an example in which the sheet processing apparatus 50 is connected into a body of the printing apparatus 1. FIG. 2B illustrates an example in which the sheet processing apparatus 50 is connected to an outside of the printing apparatus 1. In any connecting forms, the sheet processing apparatus 50 can execute the stapling process on sheets discharged by the discharge roller pair 21 of the printing apparatus 1, and the stapling process on sheets set directly on the sheet processing apparatus 50 by the user.

Figure 3:
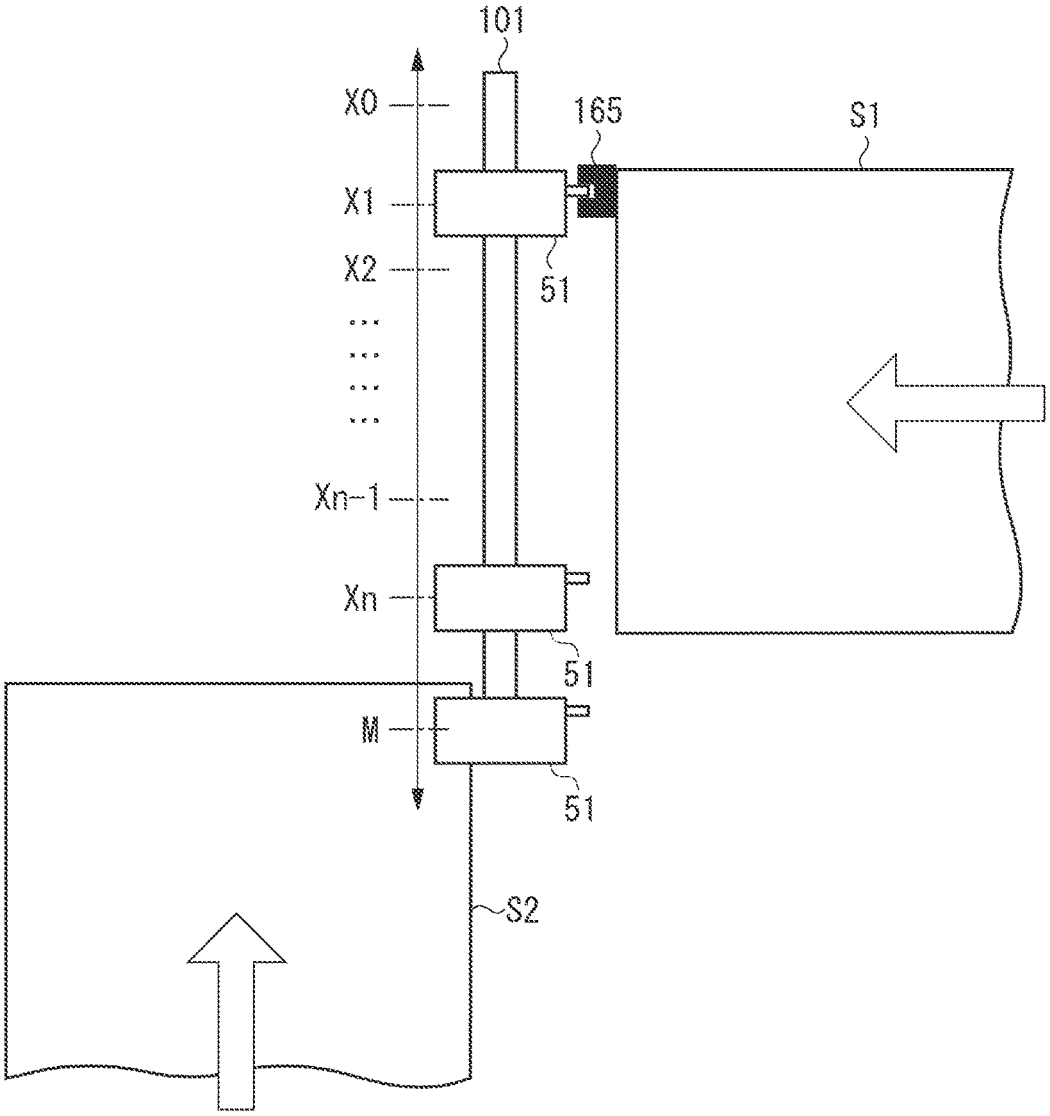
FIG. 3 is a diagram illustrating a constitution of a stapler 51 of the sheet processing apparatus 50 according to the exemplary embodiment of the present invention.

FIG. 3 is a diagram illustrating a constitution of the stapler 51 of the sheet processing apparatus 50. FIG. 3 is a cross sectional view when the sheet processing apparatus 50 is viewed from above. A lower side in FIG. 3 is a front side (near side) of the printing apparatus 1 illustrated in FIG. 1. The stapler 51 is provided to be movable along a moving path 101 to directions of arrows. The stapler 51 undertakes two roles. The first role of the stapler 51 is to execute the stapling process on sheets S1 discharged from the printing apparatus 1. The second role of the stapler 51 is to execute the stapling process on sheets S2 inserted into the sheet insertion opening 53.

In the stapling process on the sheets S1, a stapling should be executed on a staple position set by the user. For this reason, the stapler 51 is moved along the moving path 101 through driving by a stapler moving motor 164 (FIG. 4) so as to be capable of executing the stapling process on any position of positions X1, X2 . . . Xn−1, and Xn. The stapler 51 is configured to be movable also in upper and lower directions (a vertical direction), which however is not illustrated.

On the other hand, in the stapling process on the sheets S2, a stapling is executed on the sheets S2 inserted into the sheet insertion opening 53, which is provided to the front side (near side) of the sheet processing apparatus 50. For this reason, when the stapling process is executed on the sheets S2, the stapler 51 is moved to a position M situated on the front side of the sheet processing apparatus 50.

Note that the stapler 51 located on a conveyance path of the sheet S1 prevents the sheet S1 from being conveyed. For this reason, when the stapler 51 does not execute the stapling process, the stapler 51 is made to retreat to a position X0 so as not to prevent the sheet from being conveyed.

Figure 4:
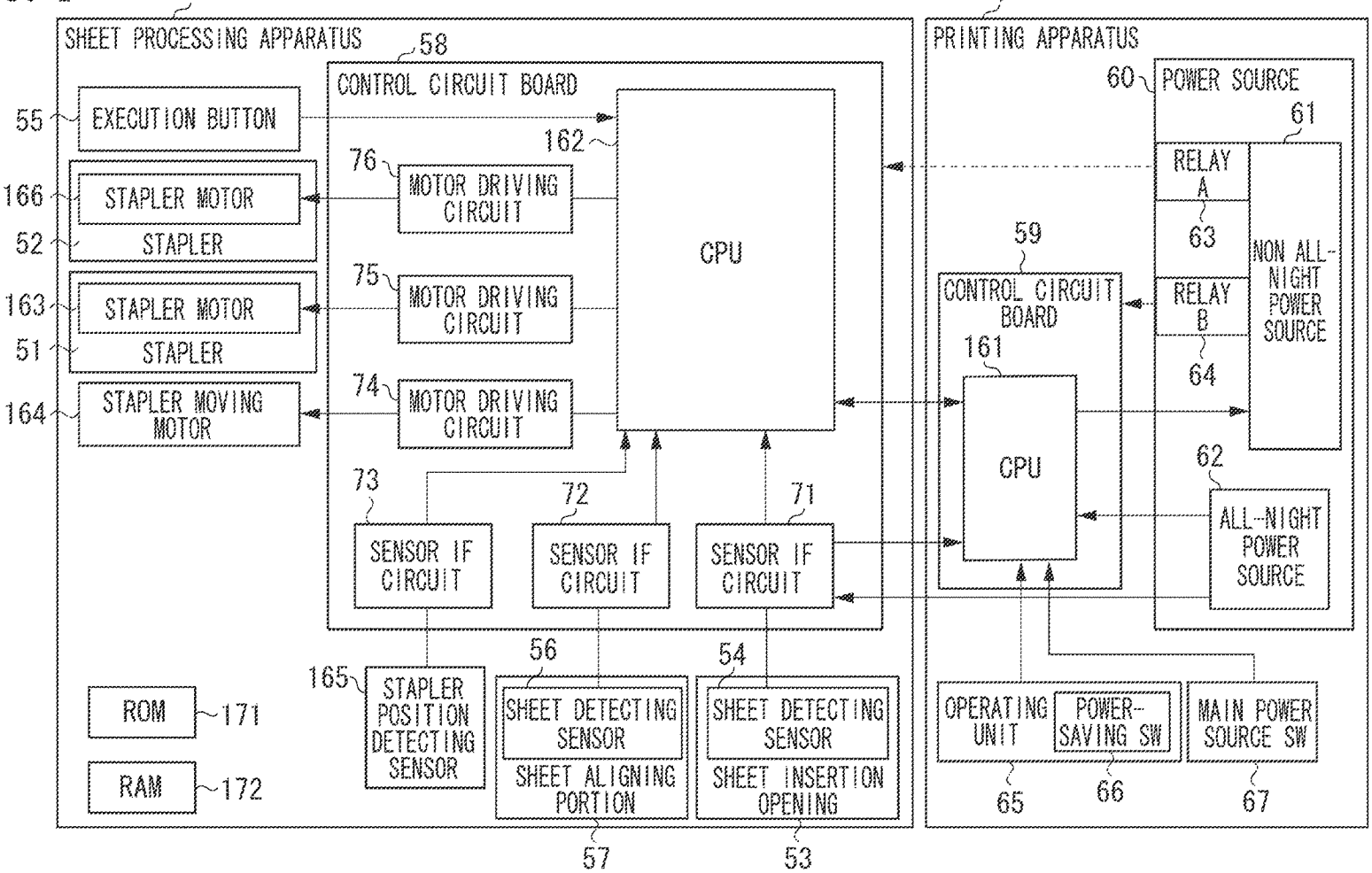
FIG. 4 is a hardware constitutional diagram illustrating a control system of the printing apparatus 1 and the sheet processing apparatus 50 according to the exemplary embodiment of the present invention.

Next, a constitution of a control system of the printing apparatus 1 and the sheet processing apparatus 50 will be described. FIG. 4 is a hardware constitutional diagram illustrating the control system of the printing apparatus 1 and the sheet processing apparatus 50. In FIG. 4, the printing apparatus 1 includes a control circuit board 59 having a central processing unit (CPU) 161, a power source 60, and an operation unit 65. The sheet processing apparatus 50 includes a control circuit board 58 having a CPU 162, the sheet detecting sensor 54, a stapler position detecting sensor 165, a stapler motor 163, and the stapler moving motor 164.

The CPU 161 of the printing apparatus 1 controls respective sections of the printing apparatus 1. When a detection is made that sheets are inserted into the sheet insertion opening 53 with the printing apparatus 1 and the sheet processing apparatus 50 having shifted to a power-saving mode, the CPU 161 functions as follows. That is to say, the CPU 161 maintains the printing apparatus 1 in the power-saving mode, and returns the sheet processing apparatus 50 from the power-saving mode. The power source 60 includes a non all-night power source 61, an all-night power source 62, a relay A63, and a relay B64. The non all-night power source 61 is connected to the control circuit board 58 via the relay A63, and is connected to the control circuit board 59 via the relay B64. The all-night power source 62 is connected to the CPU 161 of the control circuit board 59 and to a sensor interface (hereinafter referred to as "IF") circuit 71 of the control circuit board 58.

The non all-night power source 61 can supply or cut off a power according to control performed by the CPU 161. The all-night power source 62 always supplies a power to the printing apparatus 1 with a power plug of the printing apparatus 1 being inserted into an electrical outlet. A main power source SW 67 is a switch that is operated to turn on or off the power source of the printing apparatus 1. The operation unit 65 is a user interface (a display unit and a reception unit) that is used for making various settings for the printing apparatus 1 and the sheet processing apparatus 50. The operation unit 65 includes a power-saving SW 66 that is operated to shift the printing apparatus 1 to the power-saving mode or return the printing apparatus 1 from the power-saving mode.

The CPU 162 of the sheet processing apparatus 50 is connected to the CPU 161 of the printing apparatus 1 and communicates with the CPU 161 of the printing apparatus 1 so that states of the apparatuses can be detected from each other. Further, the CPU 162 reads out a control program stored in a read-only memory (ROM) 171, and performs control related to the sheet process. A random access memory (RAM) 172 is used as a main memory of the CPU 162, and a temporary storage area such as a work area. The sheet processing apparatus 50 executes various processes with one CPU 162 using one memory (the RAM 172) as illustrated in a flowchart, described below, but another mode may be also applied. For example, a plurality of CPUs and a plurality of RAMs, or a hard disk drive (HDD) and a solid state drive (SSD) can be operated in cooperation with each other to execute the respective processes. Further, a part of the process, described below, may be executed by using a hardware circuit such as an application specific integrated circuit (ASIC). Further, the printing apparatus 1 is also provided with a RAM, a ROM, and an HDD, which however is not illustrated in FIG. 4.

The CPU 162 of the sheet processing apparatus 50 is connected with the execution button 55, the sensor IF circuit 71, a sensor IF circuit 72, a sensor IF circuit 73, a motor driving circuit 74, a motor driving circuit 75, and a motor driving circuit 76. The CPU 162 controls the respective sections of the sheet processing apparatus 50 via the above respective circuits. When the sheet processing apparatus 50 shifts to the power-saving mode, the CPU 162 performs control to move the stapler 51 to the position M.

The sheet detecting sensor 56 detects presence or absence of sheets on the sheet aligning portion 57, and notifies the CPU 162 of the presence or absence of the sheets via the sensor IF circuit 72. The sheet detecting sensor 54 detects presence or absence of sheets on the sheet insertion opening 53, and notifies the CPU 162 of the presence or absence of the sheets via the sensor IF circuit 71. The stapler position detecting sensor 165 is provided to a position opposed to the moving path 101 of the stapler 51 (see FIG. 3), and detects a position of the stapler 51. Further, the stapler position detecting sensor 165 notifies the CPU 162 of a result of detection via the sensor IF circuit 73.

The stapler motor 163 is provided inside the stapler 51 and is driven by the motor driving circuit 75 to thereby drive the stapler 51. As a result, the stapler 51 executes the stapling process on the sheets. The stapler moving motor 164 is driven by the motor driving circuit 74 to thereby move the stapler 51 to any position as described above. The position of the stapler 51 is controlled by the CPU 162 based on a result of the detection obtained by the stapler position detecting sensor 165.

A stapler motor 166 is provided inside the stapler 52, and is driven by the motor driving circuit 76 to thereby drive the stapler 52. As a result, the stapler executes the stapleless stapling process on sheets. When the execution button 55 is pressed by the user, the execution button 55 transmits a signal corresponding to the pressing to the CPU 162. Further, the lighting of the LED provided to the execution button 55 is controlled by the CPU 162.

Figure 5:
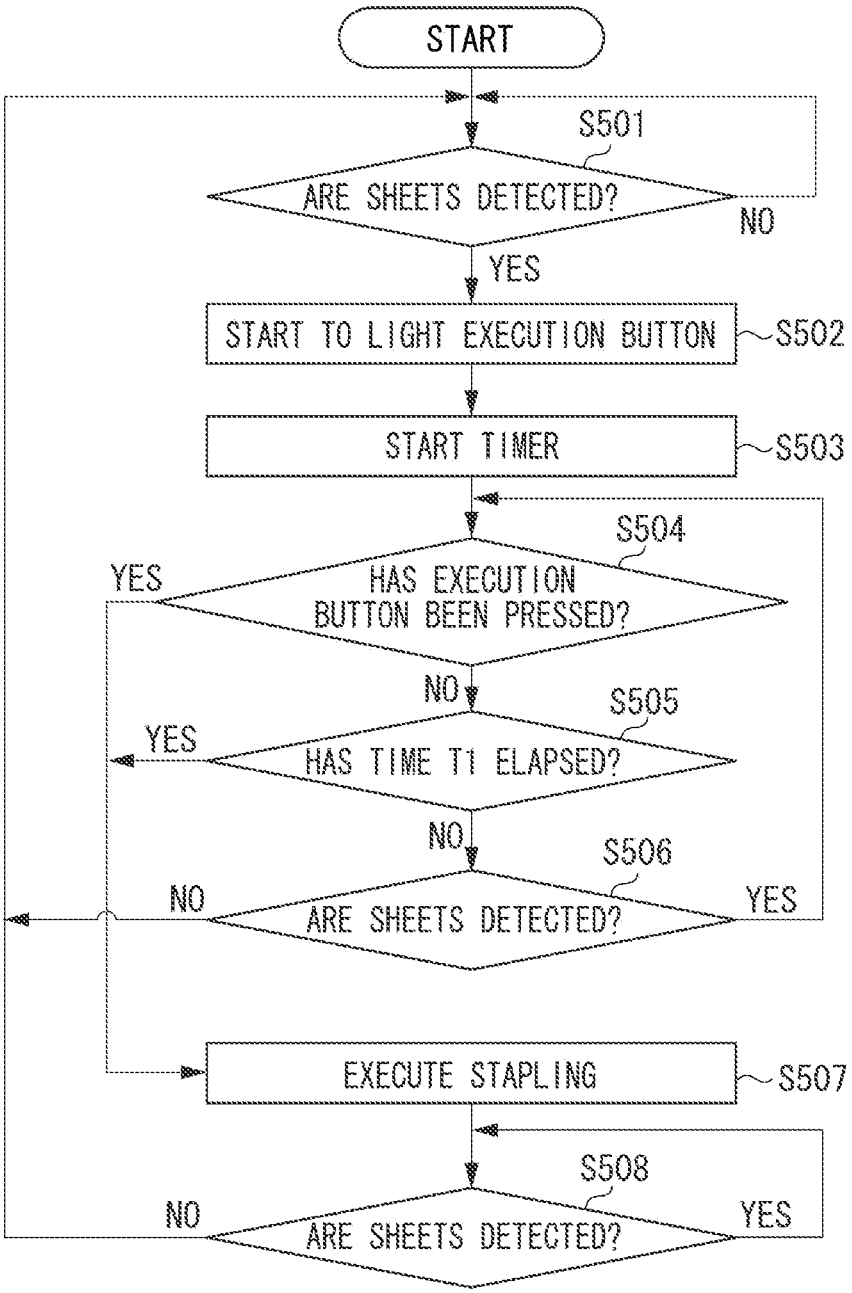
FIG. 5 is a flowchart illustrating an operation of the sheet processing apparatus 50 according to the exemplary embodiment of the present invention.

FIG. 5 is a flowchart for describing an operation of the sheet processing apparatus 50 when the stapling process is executed on sheets with use of the off-line staple function. Each operation (each step) illustrated in the flowchart of FIG. 5 is realized as a result of the CPU 162 of the sheet processing apparatus 50 executing the control program stored in the ROM 171.

In step S501, a determination is made as to whether the sheet detecting sensor 54 has detected sheets. In a case where the determination is made that the sheets have been detected (Yes in step S501), the process proceeds to step S502, and in a case where the determination is made that no sheets are detected (No in step S501), the process waits until sheets are detected.

In step S502, the LED of the execution button 55 is lighted. As a result, the user can know that the execution button 55 can be pressed (the execution of the sheet process can be instructed). At this time, the off-line mode is shifted to ON to limit printing of an image in the printing apparatus 1. The pressing of the execution button 55 is not detected until the process in step S502 is executed. Thus, even when the execution button 55 is pressed, the stapling process is not executed unless the processing in step S502 has been executed. In step S503, a timer provided to the sheet processing apparatus 50 is started.

In step S504, a determination is made as to whether the execution button 55 has been pressed. In a case where the determination is made that the execution button 55 has been pressed (Yes in step S504), the process proceeds to step S507, and in a case where the determination is made that the execution button 55 has not been pressed (No in step S504), the process proceeds to step S505. In step S505, a determination is made as to whether an elapsed time counted by the timer that has started counting in step S503 reaches a predetermined time T1. In a case where the determination is made that the elapsed time reaches the predetermined time T1 (Yes in step S505), the process proceeds to step S507, and in a case where the determination is made that the elapsed time does not reach the predetermined time T1 (No in step S505), the process proceeds to step S506.

Figure 6:
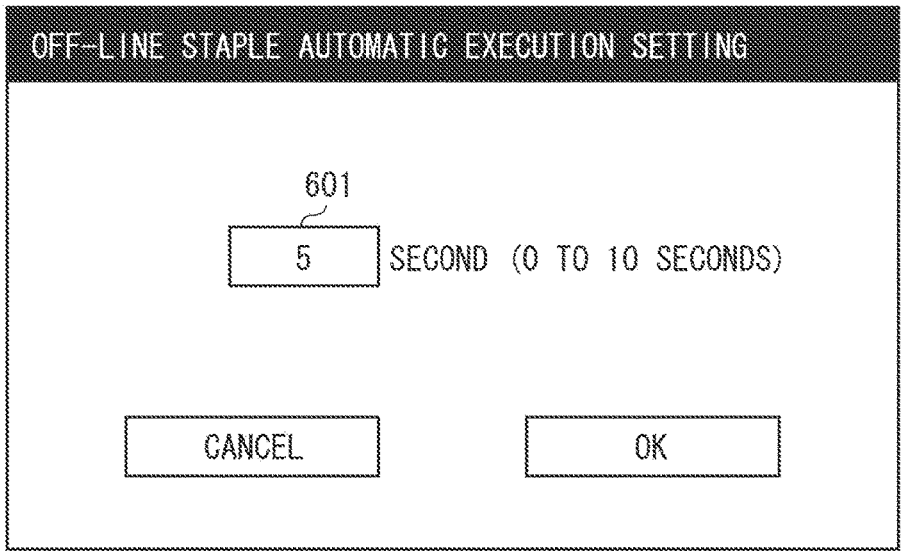
FIG. 6 illustrates an example of a setting screen displayed on the printing apparatus 1 according to the exemplary embodiment of the present invention.

FIG. 6 illustrates an example of a setting screen that is displayed on the operation unit 65 of the printing apparatus 1 and this screen is for receiving information to be used for setting the predetermined time T1 from the user. The user inputs information representing a time length into an input field 601. The setting that is made via this setting screen is stored in the ROM 171 configured to be writable.

In the illustrated example, "5" seconds is input. In this case, when a state in which the sheet detecting sensor 54 detects sheets continues for 5 seconds, the stapler 51 executes the stapling process. Since an operation for the stapling process starts after the time input by the user elapses, it takes about 0.1 second to a several seconds until the sheets are actually stapled. Further, options such as "shorter", "standard" and "longer" may be presented to the user instead of receiving the information directly representing the time length from the user.

In step S506, a determination is made as to whether the sheet detecting sensor 54 detects sheets. When the determination is made that sheets are detected (Yes in step S506), the process returns to step S504, and when the determination is made that sheets are not detected (No in step S506), the process returns to step S501. In a case where the process returns to step S501, the LED of the execution button 55 is lighted off, and the off-line mode is shifted to OFF to release the printing limitation.

When the process proceeds from step S504 to step S507, the user (manually) executes the sheet process. On the other hand, in a case where the process proceeds from step S505 to step S507, the sheet process is automatically executed according to elapse of a predetermined time. The case that the process returns from step S506 to step S501 is supposed to be a situation in which the user who once has set sheets finally decides not to execute the stapling process and pulls out the sheets.

In step S507, the stapler 51 is made to execute the stapling process on a plurality of sheets set on the sheet processing apparatus 50 (inserted into the sheet insertion opening 53). Thereafter, the LED of the execution button 55 is turned off, the off-line mode is shifted to OFF, and the printing limitation is released.

In step S508, a determination is made as to whether the sheet detecting sensor 54 detects sheets. In a case where the determination is made that sheets are not detected (No in step S508), the process returns to step S501, and in a case where the determination is made that sheets are detected (Yes in step S508), the process waits until the sheets are not detected. The process returns to step S501 on condition of non-detection of sheets so as to prevent, when sheets are still set after a stapling process is executed, the stapling process from being executed again on the same position of the same sheets.

As described above, in the first exemplary embodiment, a time period from when the sheet detecting sensor 54 detects sheets until when the stapler 51 executes the staple process can be variably set. As a result, the predetermined time T1 can be set to be longer in an environment where an unaccustomed user does works, and the predetermined time T1 can be set to be shorter in an environment where a skillful user does works. The above example illustrates the constitution where both the stapling process based on the pressing of the execution button 55 and the stapling process based on the elapse of the predetermined time T1 can be executed, but the function of executing the stapling process based on the pressing of the execution button 55 may be omitted.

A second exemplary embodiment of the present invention will be now described below. The first exemplary embodiment describes the example where the predetermined time T1 can be set based on the operation using the setting screen illustrated in FIG. 6. The second exemplary embodiment describes an example where switching can be made as to whether the execution (manual execution) of the stapling process based on reception of an execution instruction from the user is validated, and timing of the automatic execution of the stapling process is varied according to the switching. The following describes only a part different from the description given for the first exemplary embodiment, and the other parts are similar to the parts of the description given for the first exemplary embodiment.

Figure 7:
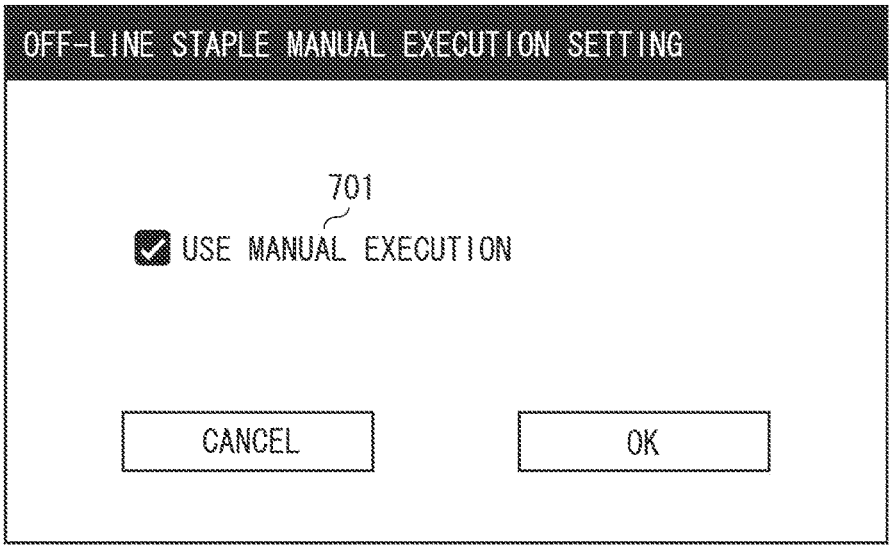
FIG. 7 illustrates an example of a setting screen displayed on the printing apparatus 1 according to the exemplary embodiment of the present invention.

FIG. 7 illustrates an example of a setting screen that is displayed on the operation unit 65 of the printing apparatus 1, and this screen is for setting whether the execution (the manual execution) of the stapling process based on the pressing of the execution button 55 is used. When a check box 701 is set checked, the execution (the manual execution) of the stapling process based on the pressing of the execution button 55 is validated. On the other hand, when the check box 701 is set unchecked, even if the execution button 55 is pressed after the sheet detecting sensor 54 detects sheets, the stapling process is not executed. The setting that is made via the setting screen is stored in the ROM 171 configured to be writable.

Figure 8:
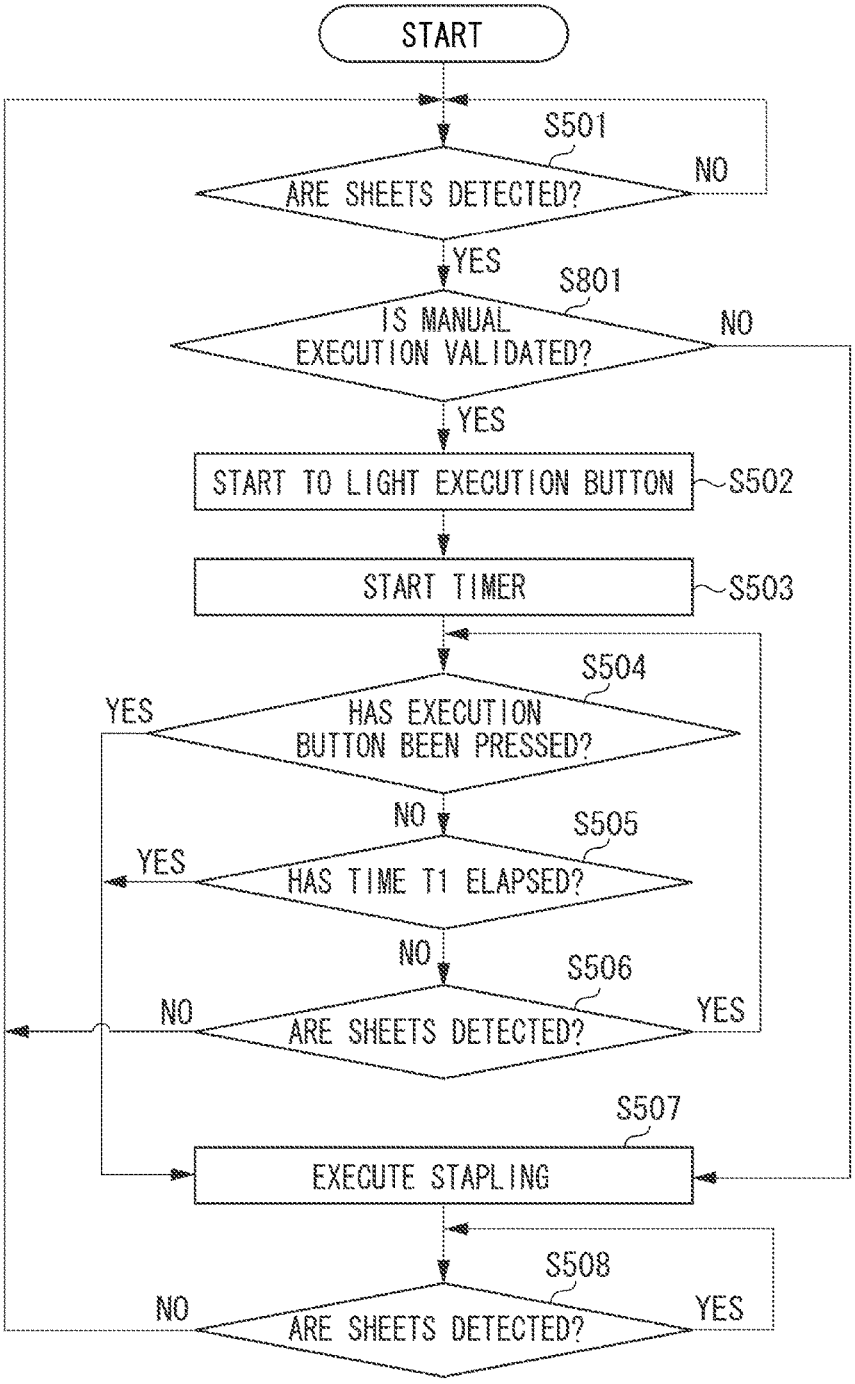
FIG. 8 is a flowchart illustrating an operation of the sheet processing apparatus 50 according to the exemplary embodiment of the present invention.

FIG. 8 is a flowchart for describing the operation of the sheet processing apparatus 50 when the stapling process is executed on sheets with use of the off-line staple function, and corresponds to the flowchart in FIG. 5 described in the first exemplary embodiment. When the flowchart in FIG. 8 is compared with the flowchart in FIG. 5, it is found that step S801 is added.

In step S501, a determination is made as to whether the sheet detecting sensor 54 has detected sheets. In a case where the determination is made that sheets have been detected (Yes in step S501), the process proceeds to step S801, and in a case where the determination is made that no sheets are detected (No in step S501), the process waits until sheets are detected.

In step S801, a determination based on information stored in the ROM 171 is made as to whether the execution of stapling process based on the reception of the execution instruction from the user is set to be validated. In a case where the determination is made as being set to be validated (Yes in step S801), the process proceeds to step S502, and in a case where the determination is made as not being set to be validated (set to be invalidated) (No in step S801), the process proceeds to step S507.

Since steps S502 to S508 are similar to steps described in the flowchart of FIG. 5, description thereof is omitted. In a case where the process proceeds directly from step S801 to step S507, the stapling process is "immediately" executed based on sheets having been detected by the sheet detecting sensor 54. In a case where the manual execution is validated, the predetermined time T1 in which a time necessary for the user to press the execution button 55 is taken into consideration is set. In a case where the manual execution is invalidated, it can be considered that the automatic execution is apparently expected. For this reason, the automatic execution is conducted at timing earlier than the case where the manual execution is validated, so that occurrence of a useless waiting time is prevented.

A term "immediately" includes a case where it takes an extra time of about 0.1 second to a few seconds until sheets are actually stapled, but the stapling process is executed at least without executing a process for waiting until the predetermined time T1 elapses. Further, besides the predetermined time T1, a predetermined time T2 shorter than T1 may be received from the user. In this case, in a case where the manual execution is set to be validated, the automatic execution is conducted based on the elapse of the predetermined time T1 whereas, in a case where the manual execution is set to be invalidated, the automatic execution is conducted based on elapse of the predetermined time T2.

In the second exemplary embodiment described above, the switching can be made as to whether the execution (the manual execution) of the stapling process based on the reception of the execution instruction from the user is validated, and the timing of the manual execution of the staple process is varied according to the switching. Specifically, in a case where the manual execution is set to be invalidated, the stapling process is automatically executed at the timing earlier than the case where the manual execution is set to be validated.

Other Embodiments

The above first and second exemplary embodiments describe, as a process to be executed with use of the off-line staple function, only the stapling process using a staple that is performed by the stapler 51. The present invention, however, may be applied also to the stapleless stapling process which is executed by the stapler 52 that uses no staple. Further, the present invention can be applied to a punching process that is executed by a puncher, not illustrated. Further, the above first and second exemplary embodiments describe the sheet processing apparatus that is connected to the printing apparatus as an example, but the present invention may be applied also to the sheet processing apparatus that is not connected to the printing apparatus. Further, the predetermined time T1 is stored by being associated with a user, and the predetermined time T1 may be controlled to be flexibly switched according to the user of the printing apparatus 1.

Embodiment(s) of the present invention can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-263179, filed Dec. 25, 2014, which is hereby incorporated by reference herein in its entirety.

What is claimed is:

1. A sheet processing apparatus comprising:

a binding unit configured to execute a binding process for binding sheets inserted into a sheet insertion opening;

a detection unit configured to detect the sheets;

a display unit configured to display a setting screen for setting a time period form when the detection unit detects the sheets until when the binding unit executes the binding process;

a receiving unit configured to receive an execution instruction of the binding process from the user; and a control unit configured to control the binding unit such that:

(i) the binding process is executed before the time period set via the setting screen elapses, in a case where the receiving unit receives the execution instruction of the binding process before the time period set via the setting screen elapses;

(ii) the binding process is executed according to the elapse of time period set via the setting screen, in a case where the receiving unit doesn't receive the execution instruction of the binding process and the time period set via the setting screen elapses.

2. The sheet processing apparatus according to claim 1, wherein in a case where execution of the sheet process based on the reception of the execution instruction is set to be invalidated, the control unit performs, based on the detection of the sheets by the detection unit, control to cause the sheet processing unit to execute the sheet process without waiting for the elapse of the time set by the setting unit.

3. The sheet processing apparatus according to claim 1, wherein a first time and a second time are set as the time period from when the detection unit has started to detect the sheets until when the sheet processing unit executes the sheet process, and wherein, in a case where execution of the sheet process based on the reception of the execution instruction is set to be validated, the control unit performs control to cause the sheet processing unit to execute the sheet process based on the first time having elapsed since the detection unit has detected the sheets whereas, in a case where the execution of the sheet process based on the reception of the execution instruction is set to be invalidated, the control unit performs control to cause the sheet processing unit to execute the sheet process based on the second time having elapsed since the detection unit has detected the sheets.

4. The sheet processing apparatus according to claim 1, wherein the sheet processing apparatus is connected to a printing apparatus, and the binding unit is executable with the binding process with respect to the sheet conveyed from the printing apparatus.

5. A method for controlling a sheet processing apparatus, the sheet processing apparatus including a binding unit configured to execute a binding process for binding sheets inserted into a sheet insertion opening, the control method comprising:

detecting the sheets;

displaying a setting screen for setting a time period from when the detection unit detects the sheets until when the binding unit executes the binding process;

receiving an execution instruction of the binding process from the user; and control the binding unit such that:

(i) the binding process is executed before the time period set via the setting screen elapses, in a case where the receiving unit receives the execution instruction of the binding process before the time period set via the setting screen elapses;

(ii) the binding process is executed according to the elapse of time period set via the setting screen, in a case where the receiving unit doesn't receive the execution instruction of the binding process and the time period set via the setting screen elapses.

6. A non-transitory computer-readable storage medium storing a program that causes a computer to perform a method for controlling a sheet processing apparatus including a sheet processing unit configured to execute a sheet process on sheets inserted into a sheet insertion opening, the method comprising:

detecting the sheets;

displaying a setting screen for setting a time period from when the detection unit detects the sheets until when the binding unit executes the binding process;

receiving an execution instruction of the binding process from the user; and control the binding unit such that:

(i) the binding process is executed before the time period set via the setting screen elapses, in a case where the receiving unit receives the execution instruction of the binding process before the time period set via the setting screen elapses;

(ii) the binding process is executed according to the elapse of time period set via the setting screen, in a case where the receiving unit doesn't receive the execution instruction of the binding process and the time period set via the setting screen elapses.

* * * * *